United States Patent [19]

Petersen

[11] Patent Number: 4,949,948

[45] Date of Patent: Aug. 21, 1990

[54] ADDRESSING SYSTEM FOR PRODUCTS LOCATED IN OR ON A PLURALITY OF STORAGE HOLDERS PARTICULARLY FOLDED PRINTED PRODUCTS

[75] Inventor: Godber Petersen, Augsburg, Fed. Rep. of Germany

[73] Assignee: Man Roland Druckmaschinen AG, Offenbach am Main, Fed. Rep. of Germany

[21] Appl. No.: 300,340

[22] Filed: Jan. 23, 1989

[30] Foreign Application Priority Data

Feb. 25, 1988 [DE] Fed. Rep. of Germany ..... 3805877

[51] Int. Cl.[5] ..... B65H 39/02

[52] U.S. Cl. ..... 270/54; 270/58

[58] Field of Search ..... 270/50, 52, 54, 55, 270/56, 57, 58

[56] References Cited

U.S. PATENT DOCUMENTS

| | | | |
|---|---|---|---|
| 3,608,888 | 9/1971 | McCain | 270/54 |
| 4,022,455 | 5/1977 | Newsome | 270/54 |
| 4,484,733 | 11/1984 | Loos | 270/54 |

FOREIGN PATENT DOCUMENTS

| | | | |
|---|---|---|---|
| 976668 | 5/1975 | Canada | 270/54 |
| 2402831 | 10/1974 | Fed. Rep. of Germany . | |
| 2727076 | 1/1978 | Fed. Rep. of Germany . | |
| 3216258 | 12/1982 | Fed. Rep. of Germany . | |
| 2708353 | 4/1985 | Fed. Rep. of Germany . | |
| 233545 | 3/1986 | German Democratic Rep. | 270/54 |
| 556747 | 12/1974 | Switzerland | 270/54 |

*Primary Examiner*—Edward K. Look
*Assistant Examiner*—Therese M. Newholm
*Attorney, Agent, or Firm*—Frishauf, Holtz, Goodman & Woodward

[57] ABSTRACT

To permit essentially simultaneous application of a plurality of address labels provided on address fields (2) on an address carrier (6) formed as an elongated strip rolled up on an address roller (31), a plurality of products 59, typically folded newspapers, are provided, in parallel and in predetermined positions, for application of the address labels under control of a control computer (103) which associates respective address labels with individually prepared products, for example newspapers with special inserts or sections to be sent to specific subscribers. A holder, controlled by the control computer, separately holds the address fields for association with the products, the holder being, for example, in form of a suction belt which moves as the products are fed past the belt, so that, in one operation, parallel located newspapers with specific inserts are individually addressed by the addresses carried on the address field as the newspapers are released from a storage holder (55) to a delivery or collecting station (104) for wrapping and/or bundling. A severing knife (68, 66) cuts the address strips, which can be pre-printed, at the individual address field for individual application of the respective address fields to the respective printed products. The severing knife has a plurality of blades so that all the address fields are, essentially, cut at one time for simultaneous application to the newspapers, magazines, or similar products.

17 Claims, 15 Drawing Sheets

ADDRESSING SYSTEM FOR PRODUCTS LOCATED IN OR ON A PLURALITY OF STORAGE HOLDERS PARTICULARLY FOLDED PRINTED PRODUCTS

Reference to prior patents and applications, assigned to the assignee of the present application, the disclosures of which are hereby incorporated by reference: U.S. Ser. No. 07/056,786, filed May 29, 1987, Kobler et al now U.S. Pat. No. 4,840,365. U.S. Ser. No. 07/060,764, filed June 10, 1987, Kobler et al, now U.S. Pat. No. 4,828,242; U.S. Ser. No. 07,308,411, filed Feb. 8, 1989, Peterson.

The present invention relates to an addressing apparatus for product which are carried in a storage holder or, generally, in a storage means, and particularly for addressing of folded printed products, such as newspapers, which are carried on an accordion-type storage holder.

Background.

It is frequently necessary to address products, and especially newspapers, magazines and other printed products which are printed and provided at high speed from rotary presses. Newspapers also are often associated with inserts, special sections and the like. It is often desired to address newspapers held in a specific storage holder to an address or to a group of addresses, whereas newspapers in another storage holder which may have different inserts therein may be addressed for different addresses or recipients. It has been customary to supply the printed products, typically newspapers, in a predetermined cadence or clock rate to an addressing apparatus, for example carrying a selective printer, such as a dot-matrix type printer, for addressing the respective newspaper. This is comparatively time-consuming and leads to another difficulty: if, for example, the stream of products being applied to the printer is not as desired, or as commanded by an addressing computer, for example by products which are inverted with respect to another, products which are damaged, improperly fed, or missing from a feeding line 1 errors in addressing may easily result. Likewise, if the address should be incorrect or be improperly provided or the printers operate improperly, errors may occur upon applying the address. A subsequent check or monitor will then detect erroneous addressing and may reject the products; in high-speed operation, the number of rejects can become substantial, requiring, effectively, manual re-addressing which introduces delays in delivery and in the overall stream of production.

The Invention.

It is an object to provide an addressing system in which the number of products can be selected as desired, and more particularly an addressing system which is especially suitable for printed folded products, such as newspapers, magazines or the like, which are retained in a storage holder. The object of the addressing system is to provide individual addresses, in the shortest possible time, to the respective products, without, however, requiring that the addressing apparatus has to react to a read-out code including reading of the code, or that a printing operation must be carried out by the addressing apparatus.

Briefly, an address carrier has address fields located thereon, in which the address fields on the address carriers have a predetermined location. The address fields, for example, carry the individual addresses of subscribers, distributors, or the like. The printed products are located on or in respective storage holders in predetermined storage locations. A control apparatus is provided which has a memory for mutually associating selected predetermined address fields with predetermined selected storage holders. The selection can be in both directions, that is, a storage holder which is placed in a position ready to have its products addressed can signal to the controller that the address fields should be applied; or, vice versa, the control apparatus may determine that predetermined address fields are ready to be applied and call for a storage holder which has the products for the selected addresses, for example newspapers with selected inserts. The controller further controls a holder which separately retrieves the address fields from the address carrier and associates the respective address fields with the products in the selected storage means or storage holder, and applies the selected address fields to the so held products in the storage holder. A cutter or severing element is provided to sever the selected address fields from the address carrier, so that the holders can apply the selected address fields to the products.

Typically, the address fields are located sequentially along a rolled-up strip which forms the address carrier; cassettes can be provided which hold a plurality of such strips rolls in tandem next to each other, or individual strip rolls on a turret, the controller then selecting the particular turret or strip roll on which the address fields, carrying pre-printed addresses, are located.

The apparatus and system in accordance with the present invention permits preprinting of the addresses on the address fields at any time, for example well in advance of printing of the newspaper. The addresses can be applied to the strips under control of a computer so that the specific address at any specific address field is determined. Checking or correction of addresses and the sequence of the addresses on the strips can be easily carried out since the preparation of the address strip is independent of the production of the products to be addressed. There is no necessity to match the operating speed of the address-generating apparatus to the delivery speed of the products.

The system further permits storage of the products, typically folded newspapers or magazines, and associating the products with selected characteristics, for example adding specific inserts, sections, or the like, in accordance with any selectable sequence. By association or, respectively, selection, of any desired number of products with respect to a predetermined one or more of address carriers, products, for example newspapers, can have individual addresses applied thereto in a minimum of time. This arrangement, then, permits generation of "individual" products, for example magazines.

In accordance with a particularly advantageous embodiment, printed products are held in holders or storage cassettes or carriers as described in application U.S. Ser. No. 07/056,786, filed May 29, 1987, Kobler et al now U.S. Pat. No. 4,840,365 and U.S. Ser. No. 07/060,764, filed June 10, 1987, Kobler et al now U.S. Pat. No. 4,828,242. the disclosures of which are hereby incorporated by reference, and assigned to the assignee of the present application. In accordance with the structures described in the aforementioned applications and patents, newspapers having, for example, different sections or inserts therein, are retained next to each other, for delivery to predetermined subscribers or distributors. In accordance with the present invention, such a storage arrangement has the advantage that, immediately upon individualizing the respective product, for example by placing selected inserts therein, the selected products in the storage holder can be addressed, effectively simultaneously. Upon addressing, it is readily possible to check the products which are in the storage holder with respect to completeness and appropriate sequence; thus, effectively error-free addressing of individualized products, and especially newspapers, and other folded products, is possible.

Drawings, showing an illustrative example:

FIGS. 2 to 7 illustrate an address strip rolling apparatus, in which

FIG. 2 is a schematic side view;

FIG. 3 is a schematic end view in the direction of the arrow B of FIG. 2;

FIG. 4 is a view similar to FIG. 2 and showing the apparatus at a different instant of time in its operating cycle;

FIG. 5 is an end view of FIG. 14 taken in the direction of the arrow C;

FIG. 6 is a schematic front view of a finished spooled address roller with a code carrier;

FIG. 7 is a general schematic view of the winding system;

FIGS. 8 to 12 show an apparatus to remove the address strips, in which

FIG. 8 shows the basic removal of a strip;

FIG. 9 is a side view of a gripping arrangement, to an enlarged scale;

FIG. 10 is a fragmentary side view in the direction of the arrow D of FIG. 9;

FIG. 11 is an end view of the braking arrangement to control run-off of the address carriers;

FIG. 12 is a fragmentary side view showing electromagnetic unlatching;

Detailed Description.

Figure 1:
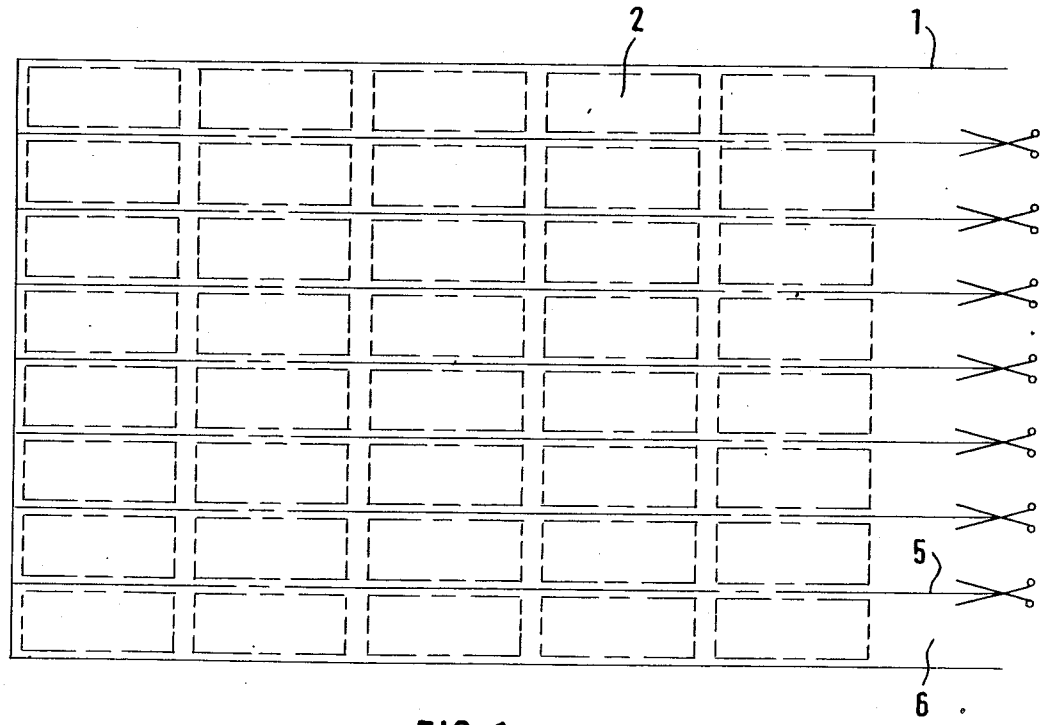
FIG. 1 is a top view of an address carrier, and showing the location of address fields.
Figure 3:
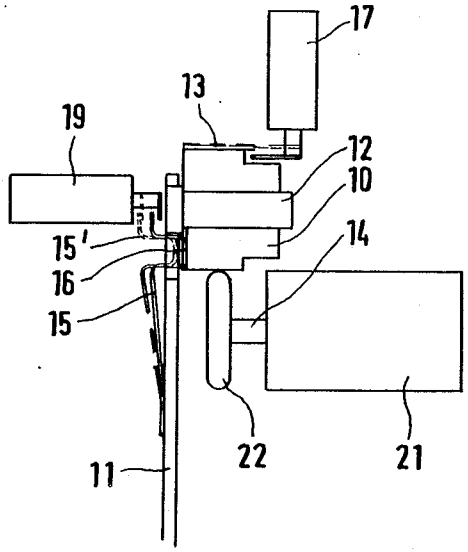
Figure 2:
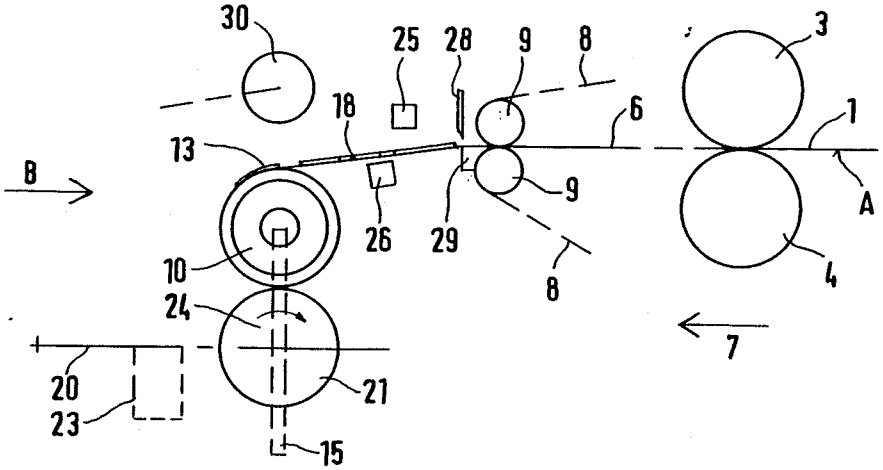

FIG. 1 is a schematic top view of an address web which is subdivided into a plurality of address fields 2, the address fields carrying individual addresses of subscribers, distributors or the like. The addresses themselves can be printed on the respective address fields by a data processing apparatus, for example a computer which prints addresses from a memory on the respective fields, as well known in addressing of labels, label carriers and the like. As schematically shown in FIG. 1, and in greater detail in FIG. 2, cutters 3, 4, for example a roller cutter with a counter roller, cut the carrier into longitudinal strips 6 along severing lines 5, to obtain a plurality of address carriers 6 in strip form, on which the respective individual addresses are located on the individual address fields, for example as determined by distribution requirements. The address strips 6 are obtained by cutting along the severing line and transporting the web carrying the cutting strips along the arrow 7 (FIG. 2). The cut strips 6, of which only a portion is shown in FIG. 1, are then transported by a belt transport system 8 to a roller 10 (FIGS. 2, 3). The addresses are on the bottom side of the carrier 6, as shown at A in FIGS. 2 and 4.

Figure 5:
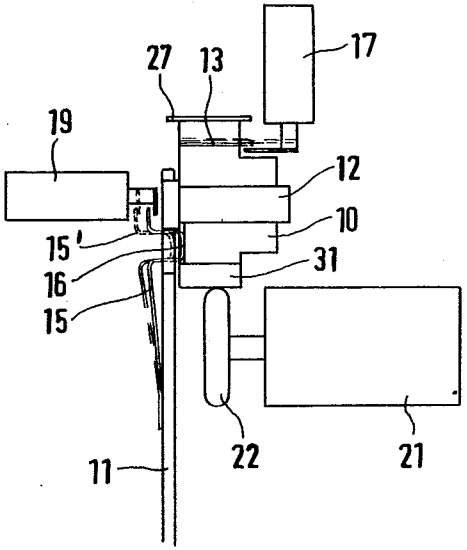

The roller 10 is rotatable about a stub shaft 12 (FIG. 5). Shaft 12, in turn, is supported on a stopped carrier disk 11 (FIGS. 3, 5). FIGS. 2 and 3 illustrate the acceptance or receiving position of the roller 10, in which FIG. 3 is a view of the apparatus of FIG. 2, taken in the direction of the arrow B of FIG. 2.

The roller 10, when still empty and not carrying the severed strip 6, is stopped by a leaf spring 15 engaging in a groove 16, as seen in FIG. 3, which shows the receiving position. A receiving tongue 13, resiliently engaging against the roller 10, is lifted off roller 10 by an electromagnet 17 to permit introduction of a starter strip of the address carrier strip 6. Laterally pivotable guide tongues 18 (FIG. 2) guide the address strip 6. When the starting portion of the address strip 6 is below tongue 13, feed of the address strip 6 is stopped, the magnet 17 is de-energized and drops off, and the tongue 13 will clamp the starting portion of the address strip.

The tongue 13 is secured to the roller 10.

Subsequently, and during a continuing portion of the roll-on cycle, the stop spring 15 is moved from the solid-line position of FIG. 3 to the position 15' shown in broken lines, by energizing magnet 19, thereby releasing the groove 16. A drive motor 21, suitably secured on a rocker bracket 20, can drive a friction wheel 22 located on the stub shaft 14 of the drive motor, the drive wheel 22 engaging the roller 10. The drive wheel 22 is pressed against the roller 10 by a spring 23, shown only schematically.

Figure 4:
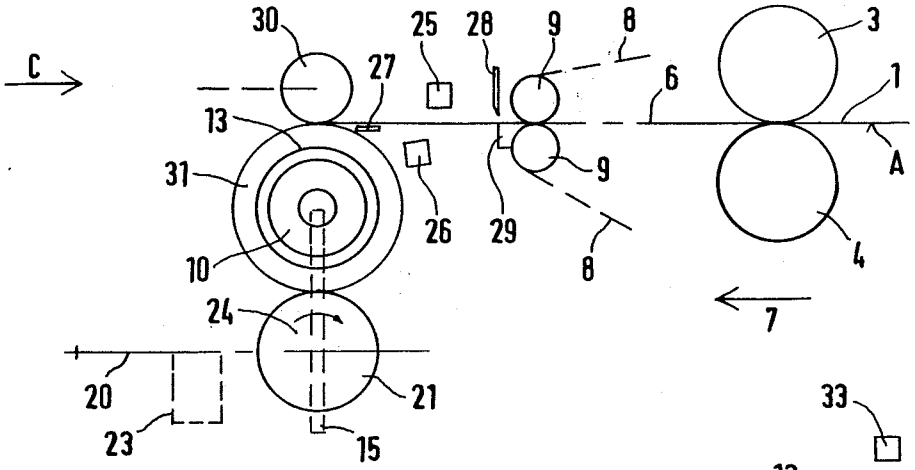

The drive motor 21 is driven to rotate in the direction of the arrow 24 (FIGS. 2, 4) and, if simultaneously the address web 1 and hence one of the strips 6 are fed, the address strip 6 can be spooled on the roll 10. Of course, the belt transport 8 likewise is operated. The web 1 and/or the strips 6 carry predetermined markers thereon which can be sensed by a sensing head 25. As soon as the respective marker, for example in form of a contrasting stripe or the like, or in form of a bar code, is sensed by the sensing head 25, wind-up of the strip is stopped. The last portion of the address strip 6 has adhesive sprayed thereon, preferably from a nozzle 26 from below. A suitable gripper, for example suction-operated, removes a code carrier 27 from a storage holder — not shown — and applies it, from below, on the strip 6, as best seen in FIG. 4. Knife 28 severs strip 6 by downward push against a cutter edge 29 and, under slow feed in the direction of the arrow 7 by the motor 21, the coding strip 27 is adhered beneath the end of the strip, and the end of the strip itself is adhered to the now completely spooled address roller 31 by a soft rubber counter roller 30.

Figure 6:
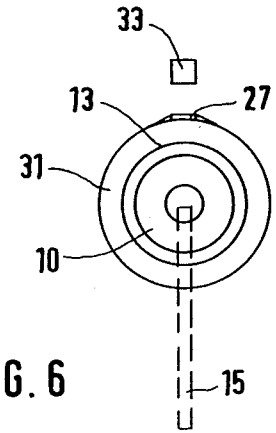

Magnet 19 is then de-energized so that the spring 15 can again engage in the groove 16 when the groove next meets the position of the spring. The groove is so located that the code carrier 27 precisely faces the outside. This is illustrated in FIG. 5, which is a view along the arrow C of FIG. 4. FIG. 6 illustrates the finished spooled and stopped or locked address roller with the code carrier 27 which can be encoded as well known by the coding head 13, for example by applying the bar code on the code carrier or magnetically encoding the code carrier.

Figure 7:
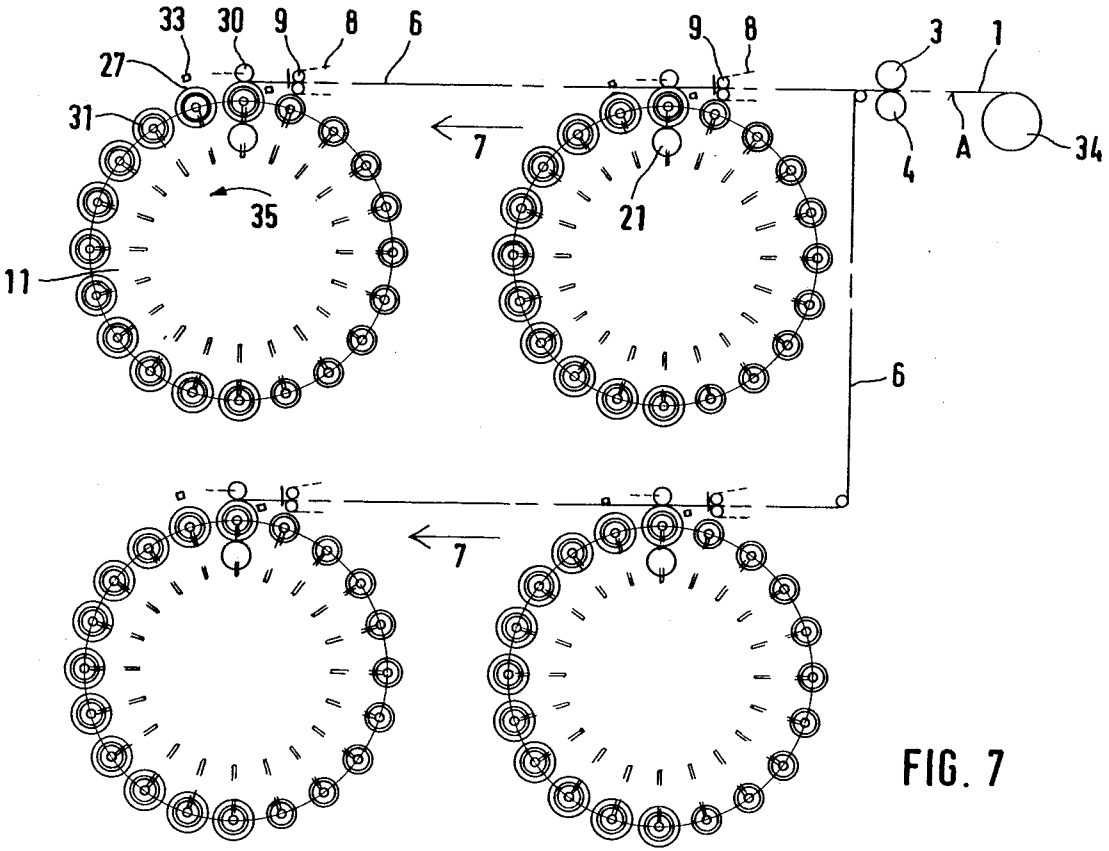

FIG. 7 is a general schematic diagram of the roll-up system. In advance of the longitudinal slitting, the web 1 is preferably spooled off from a supply reel 34. The address field 2 must be at the bottom, as indicated by the reference letter A so that, upon spooling of the roll 10, they likewise will be at the inside of the spool. As seen in FIG. 7, a plurality of carrier disks 11 are provided, each receiving at its circumference a substantial number of address rollers 31. After spooling an address roll on one of the rollers 10, the spool 11 is moved in the direction of the arrow 35 to receive a further spool thereon. A plurality of carrier disks 11, as illustrated in FIG. 7, can receive a substantial number of parallel cut address strips 6. The carrier disks 11 physically can be located adjacent each other, the diagram of FIG. 7 merely being a flow diagram for the spooling operation, and not geometrically correct. Completely filled carrier disks 11 can be brought to the addressing apparatus, as required.

FIGS. 8 to 12 illustrate the addressing apparatus itself, that is, how the addresses, for example in form of labels, are applied to the products, typically folded newspapers, or other folded printed matter.

Figure 8:
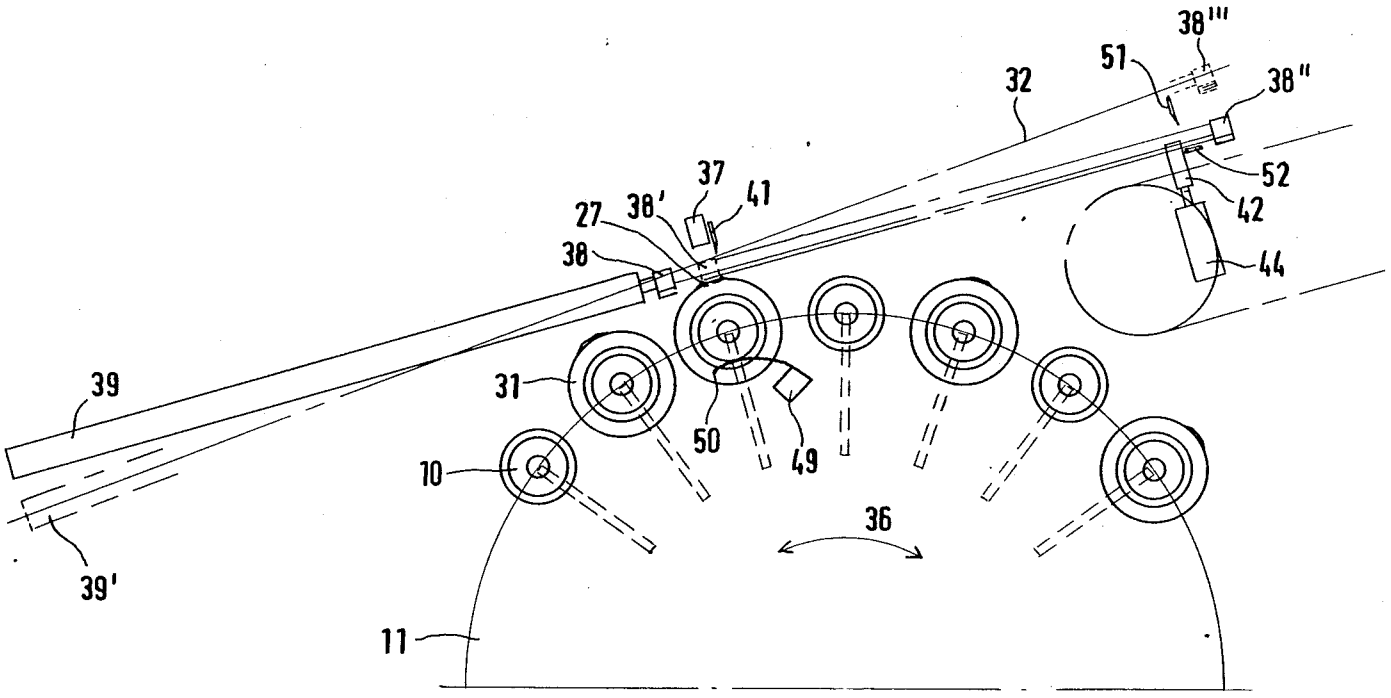
Figure 12:
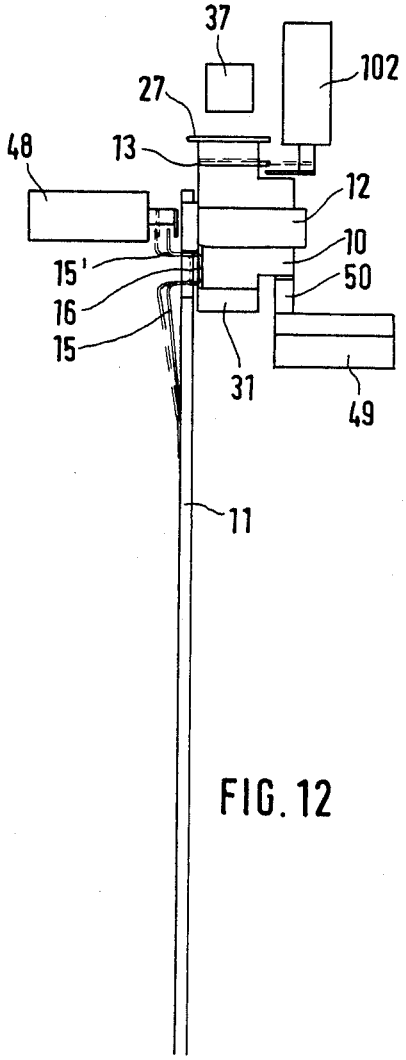

As shown in FIG. 8, a carrier disk is rotated in one of the two directions of the arrow 36, so that the code carrier 27 will pass a code reader 37. The carrier disk 11 is stopped when the code reader 37 reads the addressed code. A gripper arm 38, coupled to a piston rod of a pneumatic piston 39, is moved in the position 38' (FIG. 8) to receive the code carrier 27. The code carrier 27 is somewhat wider than the address strip 6, see FIG. 12, shown as the roll 31 on the roller 10.

Figure 9:
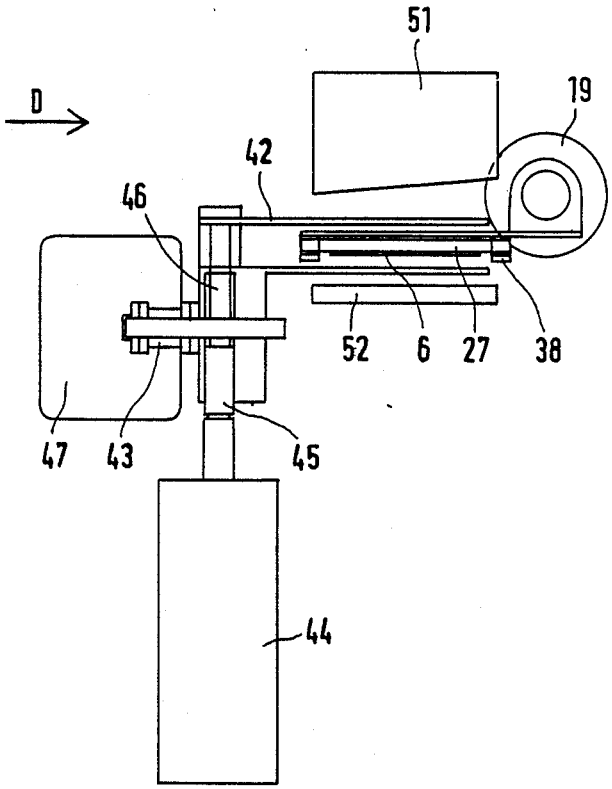
Figure 10:
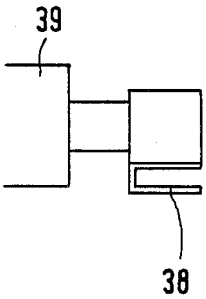
Figure 11:
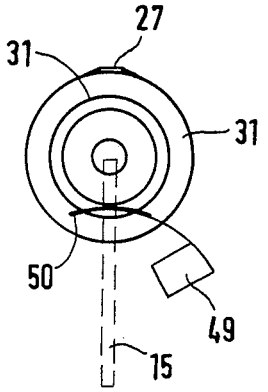

The pick-up of the code carrier is best seen in FIGS. 9 and 10, in which FIG. 10 is a side view taken in the direction of the arrow D of FIG. 9. An abrupt movement of the cutter knife 41 severs the adhered end of the address strip 6 directly adjacent the code carrier 27. A transport gripper 42, secured to a transport chain 43, is moved in the position shown in FIG. 8. Electromagnet 44 opens the transport gripper 42 when it is in this position, as shown in FIG. 9, by pressing a pin 45 upwardly counter a spring 46. The transport chain 43 is supported on a chain guide 47. FIG. 12 shows the position of the roller 10. Electromagnet or solenoid 48 unlocks the roll 10 by pulling the leaf spring 15 from groove 16 into the position 15'. The pneumatic piston 39 moves the gripper 38, which is secured thereto, to the position shown in FIG. 8 at 38''. The code carrier 27, and the address strip 6 attached thereto, is thereby carried along. The receiving gripper 38, in this movement, passes through the opened transport gripper 42, as best seen in FIG. 9. The address strip 6 is held taut by a braking strip or tongue 50 which presses against the roll 10. Tongue 50 is held at one end in fixed position on a holder 49 secured, for example, to a frame, other suitable support , or on disk 1. When the electromagnet 44 is de-energized, the transport gripper 42 will close and clamp the address strip. A knife 51 severs the projecting strip, by engagement with a counter element 52 located at the side of the code carrier. The pneumatic cylinder 39, and with it the receiving gripper 38, pivot, as seen in FIG. 8, from the position 38'' into the position 38'''. This, then, permits the chain to pull the address strip 6 with fast forward feed into the addressing apparatus as such.

Figure 13:
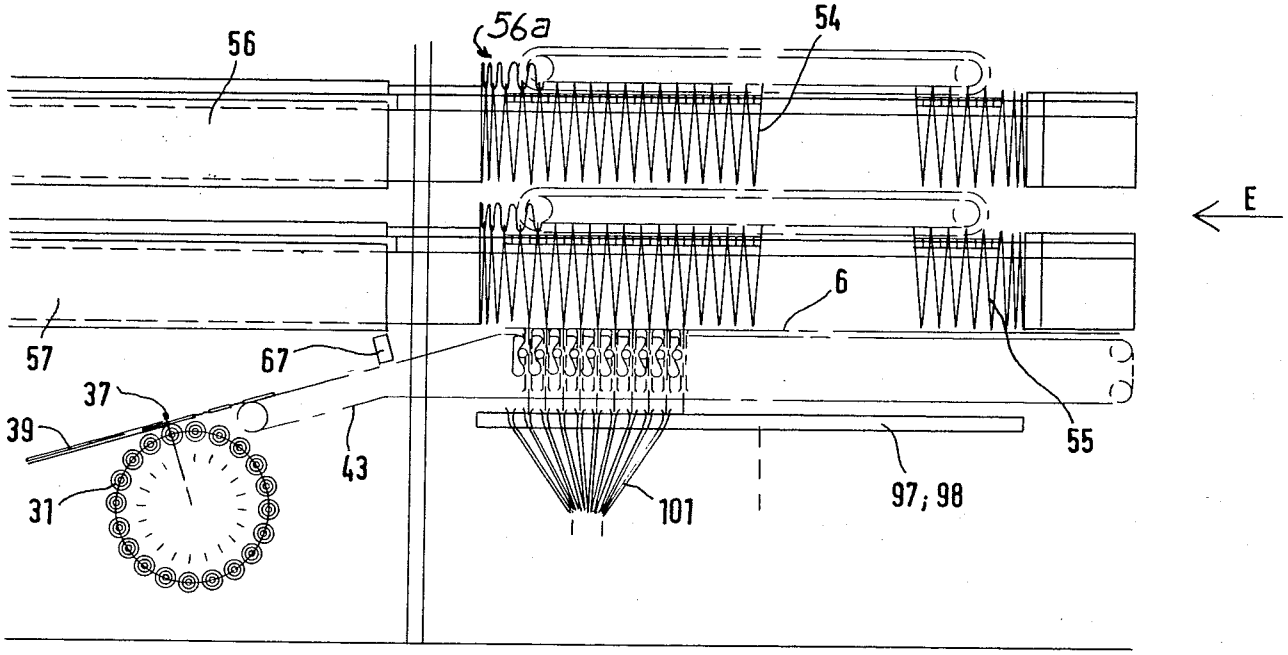
FIG. 13 is a highly schematic side view of the addressing apparatus associated with products held in accordion storage holders.
Figure 14:
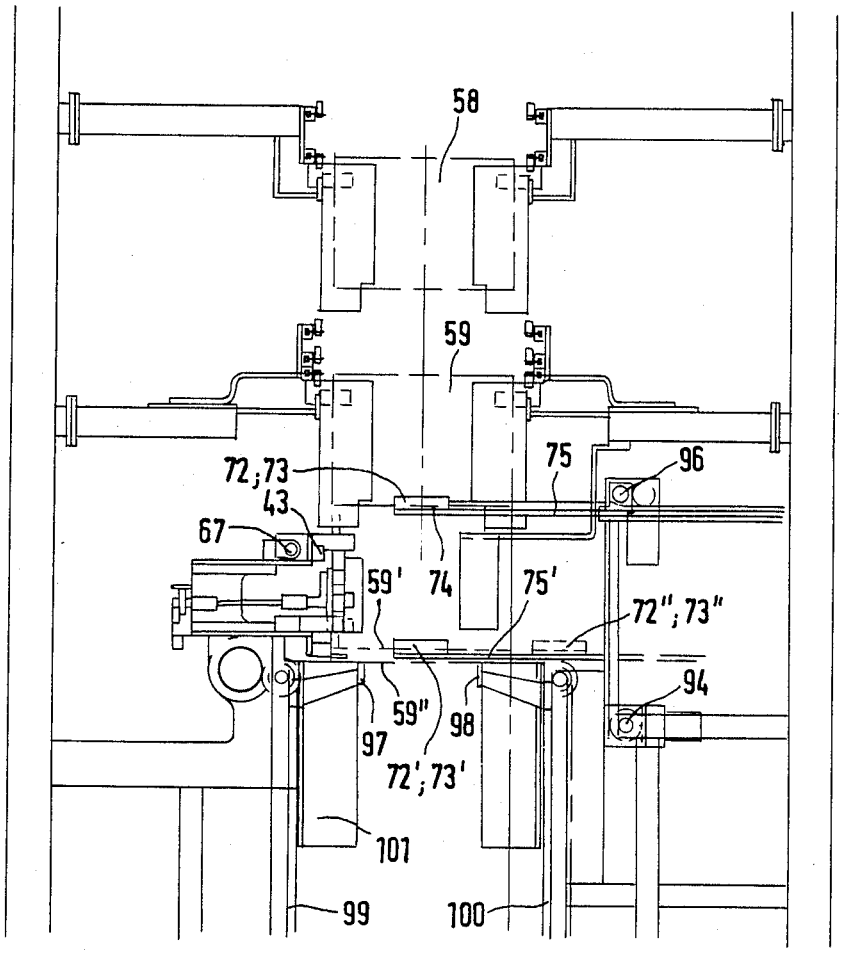
FIG. 14 is a fragmentary end view of FIG. 13, omitting all elements not necessary for an understanding of the system and its operation.

Referring now to FIGS. 13 and 14, in which FIG. 14 is an end view of the apparatus of FIG. 13, taken in the direction of the arrow E of FIG. 13.

Addressing is most suitably and preferably carried out immediately after an insertion step, as described in the referenced applications and patents in the introduction to the present specification. As described in these applications and patents, carrier structures 54, 55 are provided which can be pulled out of storage cassettes 56, 57. The carrier structures 55 retain sheet products 58, 59, and especially folded sheet products, the products 58 being physically positioned above the sheet products 59. As described in the aforementioned applications and patents, the upper folded products 58 are removed from the carrier structures 54, for example by lateral spreading of the holders for the products 58, to fall down, or being moved into the lower products 59 in the lower carrier structure 55. The products 59 are uniformly distributed, and uniformly spaced from each other in the lower carrier structure 54, and are then simultaneously addressed as will appear.

The previously described fast forward movement or feed of the transport chain 43, and hence the spooling off of the address strip 6, can be carried out simultaneously during drawing-out, in accordion-pleated form, of the carrier structures 54, 55 when they are being removed from the storage cassettes 56, 57. A braking tongue retains the address strip 6 in taut condition. Preferably, during the spooling-off portion of the addressing cycle, an adhesive spray nozzle 67 (FIG. 13) sprays adhesive on the adhesion side of the address strip 6. After spooling off, the address strip 6 is held in its entire length tightly stretched beneath the carrier structure 55, see FIGS. 13 and 15. Tube connections 60 and hoses 61 generate a vacuum in ducts 62 of a toothed belt carrier 63, see FIGS. 15 and 16–18. As best seen in FIG. 16, a belt 64 is formed with small openings or bores 65 in selected regions thereof, over which the vacuum supplied from duct 60 and hoses 61 can pick up the address strip 6 by suction and carry it to a cutter plate 66.

Figure 15:
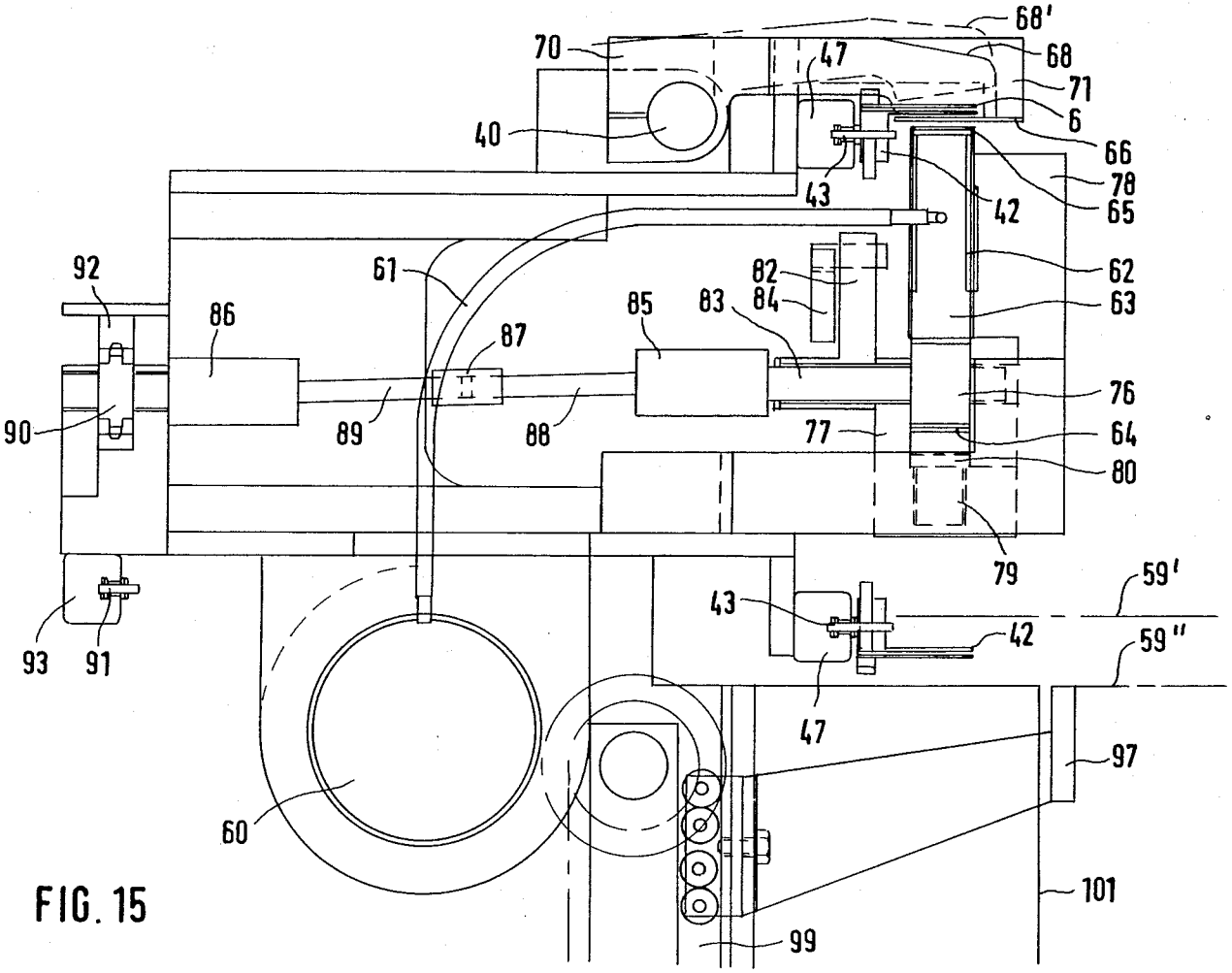
FIG. 15 is an enlarged fragmentary view of FIG. 14, showing a portion thereof to an enlarged scale.
Figure 16:
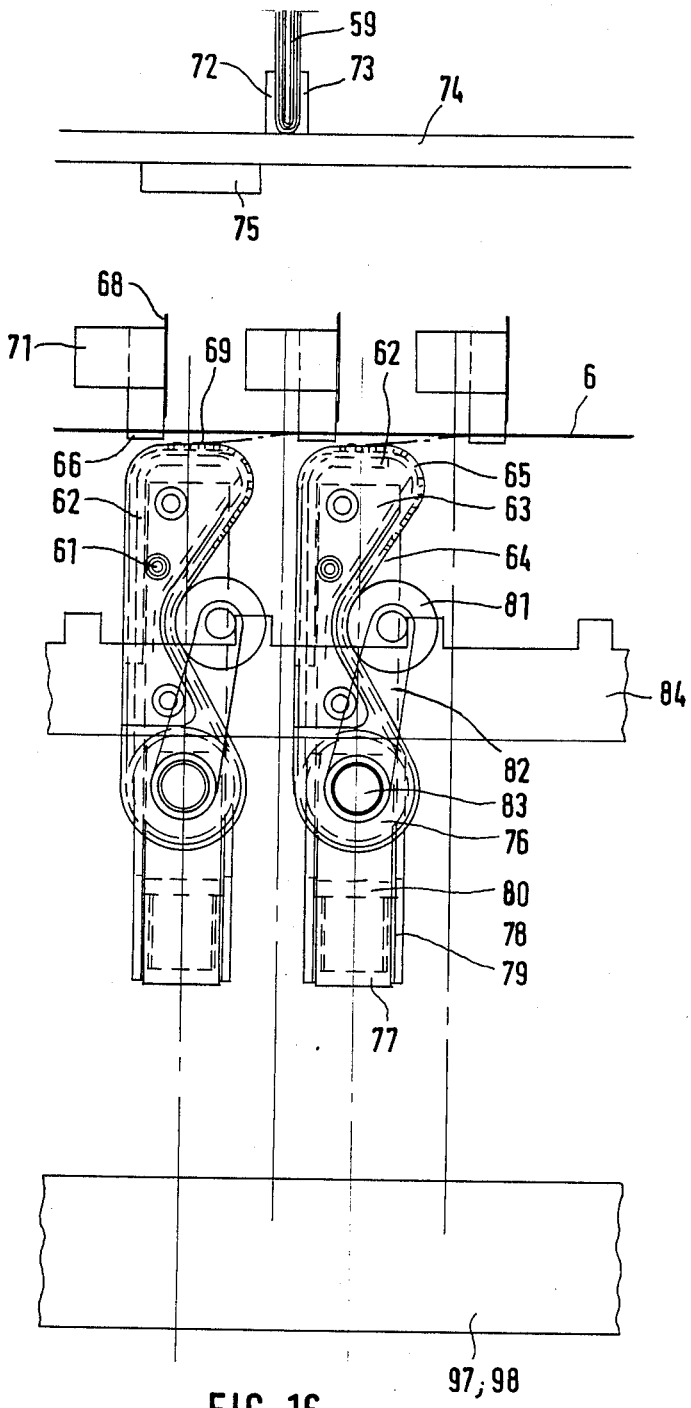
FIG. 16 is an enlarged fragmentary view, showing another portion of the system of FIG. 14.
Figure 19:
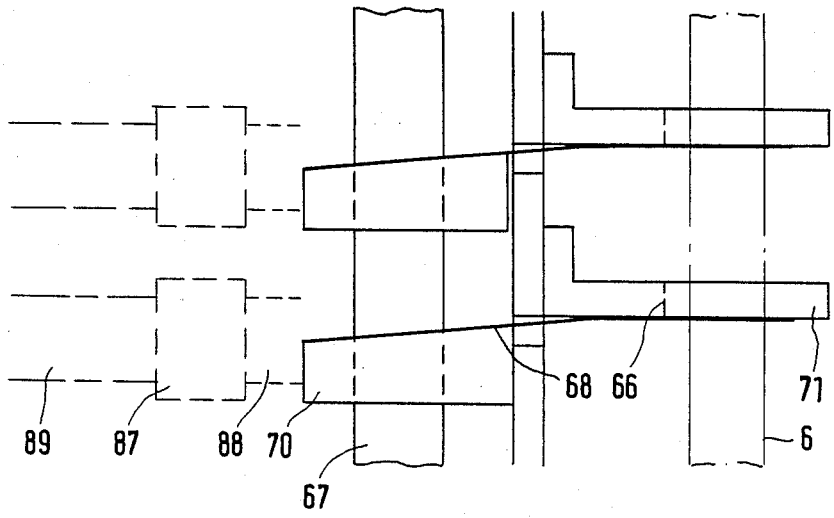
FIG. 19 is a top view of the embodiment of FIG. 15 and illustrating the severing mechanism.

FIG. 15 illustrates the actual addressing portion of the addressing apparatus of FIGS. 13 and 14 to a greatly enlarged scale. The cutter knives 68, secured to a shaft 40, pivot from the position 68' downwardly, and by means of the counter plate 66, sever the address strips 6 in individual address labels 69. FIG. 19 is a top view of the apparatus of FIG. 15. The knives 68 are secured to levers 70 which, in turn, are coupled to the shaft 40. The attachment of the cutter plates 66 on carriers 71 is likewise illustrated. The knives 68 are very thin and are made of hardened sheet steel and are pressed under axial pressure, slightly buckled or bowed, against the cutter plates 66 in order to obtain a clean scissor-like cut to sever the address strips 6 into individual address labels, each carrying: an address field 2.

The remainder of the strip from the spooled-off roller 10 up to the first address field is carried to a scrap container, not shown, by a suitable gripper mechanism, likewise not shown. The holding tongue 13 on the roller 10 is released by energizing an electromagnet 102. When magnet 48 is deenergized and drops out, the leaf spring 15 again locks roller 10 in its initial or starting position, see FIG. 12.

FIG. 16 illustrates how the vacuum pulls the leading end of the address label 69 on the gear belt 64 adjacent the cutting position; they are there retained by vacuum.

The printed products 59 which are to be addressed are, in this portion of the operating cycle, in the position shown in FIG. 16. They are held by grippers 72 and 73 against a gripper rail 74 which, in turn, is secured to arms 75.

Figure 17:
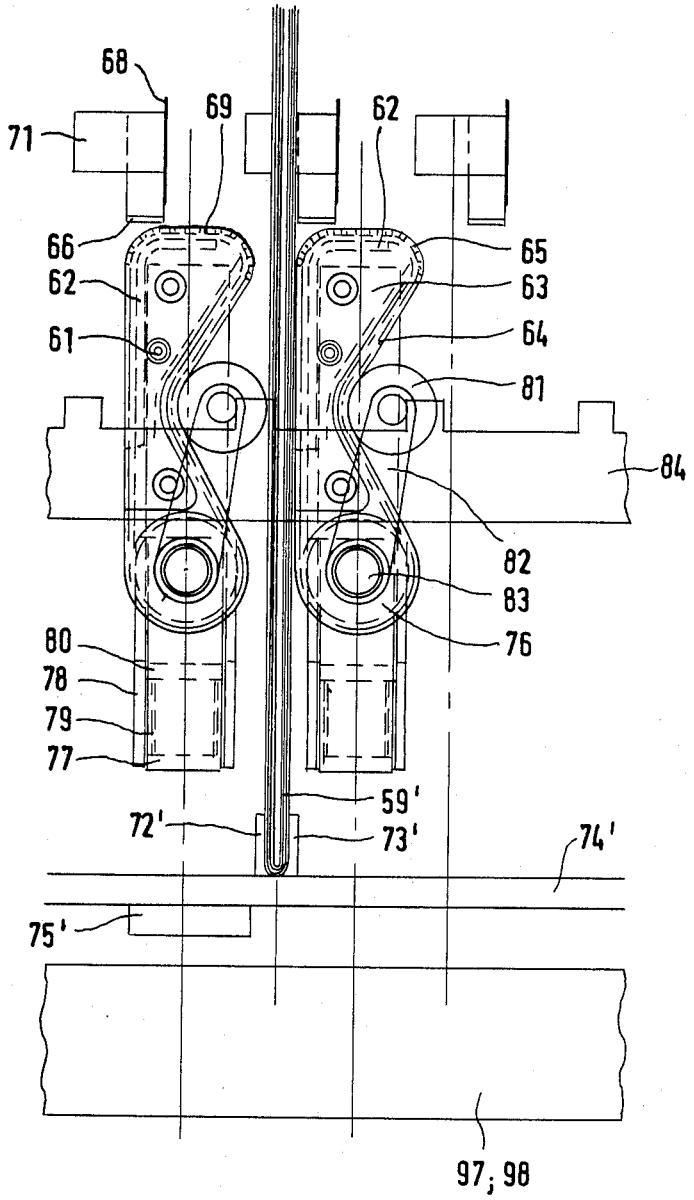
FIG. 17 is an enlarged fragmentary view, similar to FIG. 16 during another instant of time in the operating cycle of the apparatus.
Figure 20:
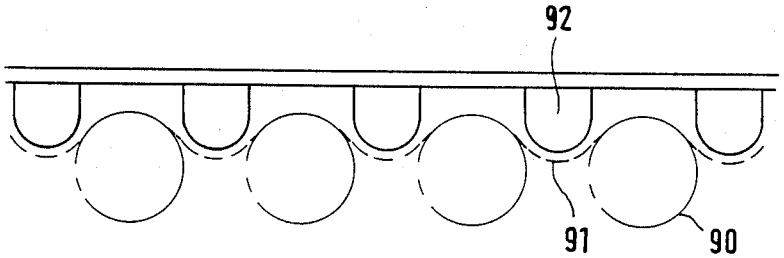
FIG. 20 is a schematic illustration of a drive for sprocket wheels and a sprocket chain.

In the next portion of the cycle, shown in FIG. 17, the address label 69, held on the surface of the gear belt 64 by vacuum, is pulled into the starting position for adhesion on the printed product. The gear belt 64 is driven by a gear wheel or sprocket 76 which is supported in a guide 77 to be vertically movable. Guide 77 is guided in a housing 78. Spring 79, supported against a plate 80 in the housing 78, retains the gear belt 64 in tensioned condition. The pressure rollers 81 can pivot by means of a lever 82; they are supported on a drive shaft 83 of the gear wheel 76. They are held, in common, by an engagement rail 84 (FIGS. 16, 17) in the positions shown. A drive shaft 83 drives the gear wheel 76, with elastic couplings or clutches 85, 86 and a positioning clutch 87 interposed, from a sprocket wheel 90 (FIG. 15) and coupling shafts 8 and 89. The sprocket wheel 90 (FIG. 15) is driven centrally for all label applying stations by a chain 91. FIG. 20 schematically shows the drive for the sprocket wheels 90, the chain 91 being guided by guides 92 about the respective sprocket wheels 90. The return run of the chain 91 is placed in a guide housing 93 (see FIG. 15).

FIGS. 14 and 17 show the grippers 72 and 73 which pull the printed products 59 past the pressure rollers 81, operated by a drive 94. The pressure rollers 81 are held in the position 59' by the rail 84; the address labels 69 initially remain in the position shown in FIG. 17. Movement of the address labels 69 is independent of the movement of the printed products 59. Each one of the movements is independently controlled. It is thus possible to maintain the specific location of application or adhesion of the labels on the printed products 59 in precisely predetermined position or, if desired, to freely select the position.

Figure 18:
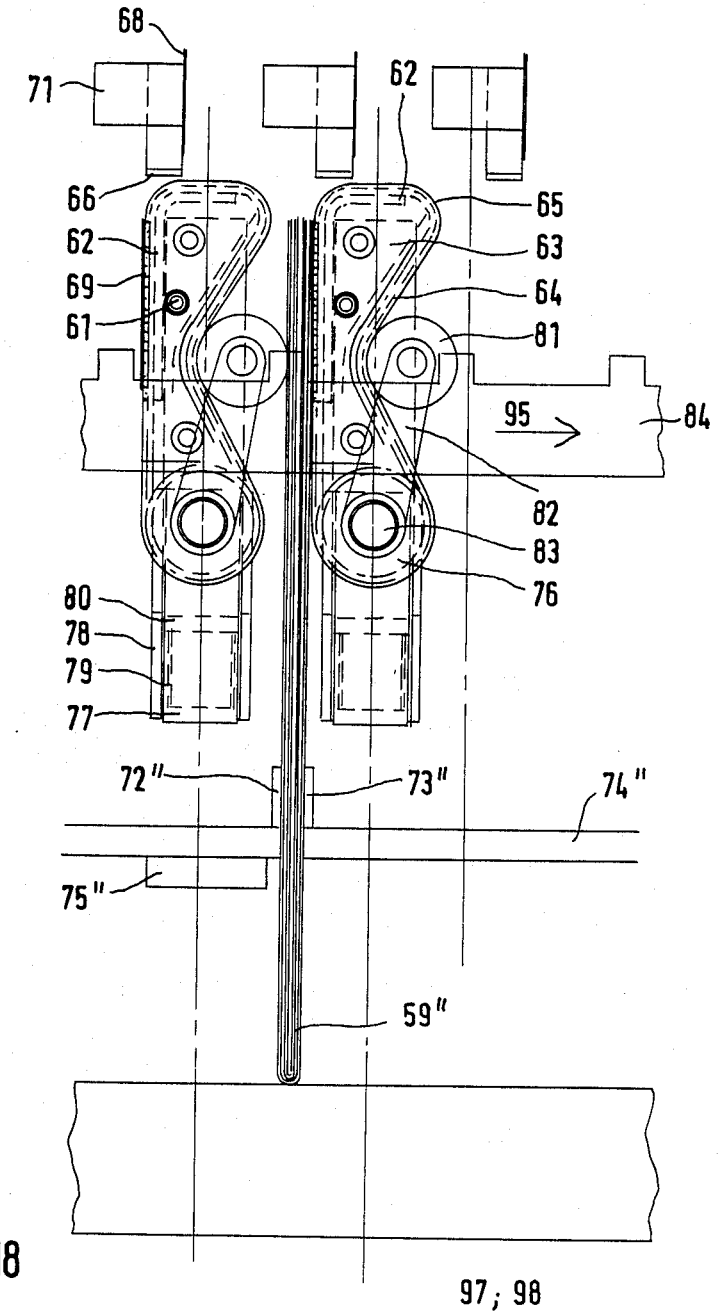
FIG. 18 is a view similar to FIG. 17 and showing the operation of the system at a later instant of time.

FIG. 18 illustrates that the address label 69 is to be adhered to an end portion of the printed product 59. The engagement strip 84, by movement in the direction of the arrow 95, releases the pressure rollers 81, which thereby presses the printed product 59 on the surface of the gear belt by tension applied against the gear belt by the spring 79. The pressure rollers 81, thus, function as counter pressure rollers. Grippers 72 and 73 now release the product 59 and by means of the drive 96 move into the positions 72'' and 73'''. Rails 97, 98 take over the function of supporting the products 59. Rails 97 and 98, by smooth uniform downward movement under control of the chains 99 and 100, now guide the product 59. The gear belt 64, which is driven at the same speed, now carries out adhesion of the label 69 under assistance of the pressure rollers 81, as illustrated in FIG. 18.

The products 59 are guided by the tongues 101 (FIG. 13). By continuous lowering of the rails 97, 98, the products can be led directly to a removal position 104 (FIG. 21) where they can be packaged or strapped.

This apparatus functions in parallel; as illustrated, the parallel operation permits simultaneous application of pre-addressed labels to any number of printed products in a single working step. When used in combination with a preceding insertion process and subsequent packing or strapping, substantial time saving and operating economy can be effected.

The structure has been described utilizing as holders gear belts or vacuum belts or webs, respectively. Other holding and clamping mechanisms may be used, for example mechanically or magnetically operating devices. Rather than using address strip 6 on which addresses are printed, magnetic address carriers can be used, or other carriers which carry machine readable addresses or codes. Preferably, the address strips are subdivided only when they are held by the individual holding and clamping and sensing apparatus, in sections. It is, however, equally possible to grip selected and severed address carriers, for example by means of suction apparatus, and position the particular, so selected address carriers on the products to be addressed, such that the predetermined sequence of the addressed products matches the sequence of addresses to which they are to be delivered.

Various changes and modifications may be made within the scope of the inventive concept, as illustrated above.

Figure 21:
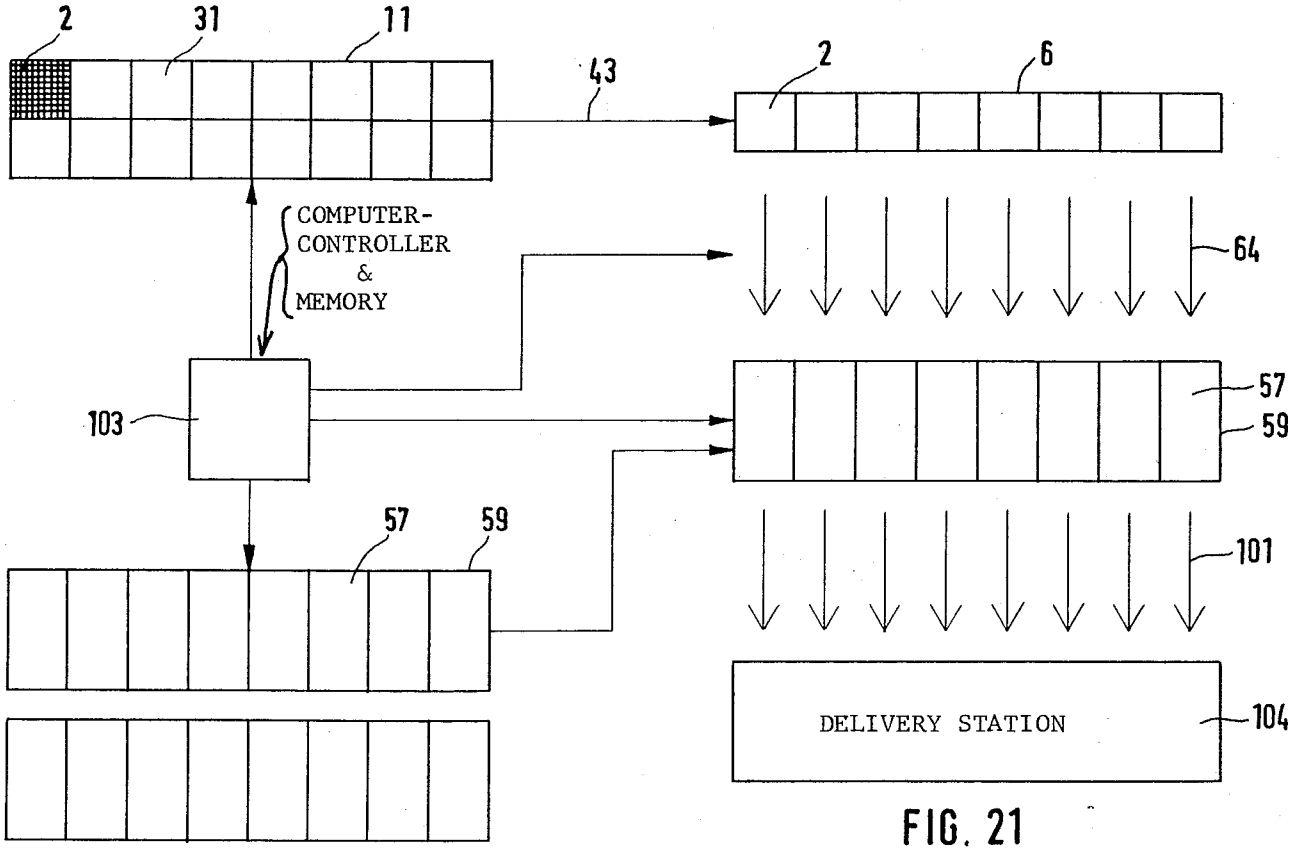
FIG. 21 is a schematic diagram showing the overall function of the system.

The overall system is schematically shown in FIG. 21. A control apparatus, for example a computer 103, selects an address strip 6 in which, in predetermined sequence or pattern, the addresses are located in address fields 2. The addresses, the strips and the pattern correspond to or are associated with the products 59 in a specific storage cassette 57, and positioned in the same sequence in the storage cassette 57 as the addresses on the address strips 6. The address strips 6 are then supplied via the transport chain 43. After the individual address fields 2 are gripped by holders, for example the vacuum gear belt 64, the address fields 2 with the addresses thereon are applied on the respective products 59 to be addressed which, previously, have been separated from each other, so that they can be uniquely identified by a position. The tongues 101 then lead the now addressed products 59 to the delivery position 104.

The disk 11 functions as an address strip storage element, and carries the respective address rolls 31, which each contain an address strip 6. The computer-controller 103 thus associates the respective address carrier 6 and the groups of products to be addressed by the individual addresses on the individual address fields 2 of the particular address carrier 6.

I claim:

1. Addressing system for addressing of products located on a plurality of storage means, particularly for addressing of printed products, wherein said printed products are located in or on the respective storage means (55) in predetermined product locations of the storage means, said system comprising a plurality of address carriers (6);

a plurality of address fields on each of said carriers, the fields, respectively, containing the addresses of recipients of the products and located at predetermined field locations on the respective address carriers;

a control means (103) having a memory for mutually associating a selected predetermined address carrier (6) and at least one address field thereon with the products at selected predetermined locations of the storage means (55);

severing means (68, 66) severing selected address fields from the selected address carrier (6); and address holder and application means (64, 65) controlled by the control means (103) separately holding the severed address fields associated with the products (59) and applying the so selected and held address fields (2) to the associated products.

2. The system of claim 1, wherein the address carriers (6) are in strip form rolled on an address carrier roller (31);

the control means (103) controlling the selection of a selected one of the address carrier rollers;

and transfer means (FIGS. 8, 9, 10) are provided for transferring the selected address carrier (6) of the selected address carrier roller (31) to the selected associated storage means (55) for application of the selected address fields to the products.

3. The system of claim 1, wherein the storage means (55) comprises accordion-like expandable and compressible structures defining expandable and compressible pockets;

and wherein the products comprise folded printed products located in predetermined pockets of the accordion-like storage means.

4. The system of claim 3, further including retention means (57) retaining the accordion-like holding means in essentially compressed storage position;

means (56a) are provided for removing the accordion-like pocket structure from the retention means and expanding the accordion-like pocket structure;

and wherein said holder means place the selected address carrier (6) adjacent the expanded pockets of the holder means while the pockets of the holder means are being expanded upon removal from the retention means.

5. The system of claim 1, wherein the holder means include movable suction webs (64, 65) located to hold, by suction, the address carrier;

and wherein the severing means (68, 66) cut the address carrier to sever the address carrier into the respective address fields to form labels carrying the addresses for application on the respective products (59).

6. The system of claim 5, further including transport chain means (43) coupled to said holder means to pull the address carrier (6) along the storage means (55);

and an adhesive applying means (67) for coating the address carrier with an adhesive for adhesively applying the address fields to the products.

7. The system of claim 5, further including product gripper means (72, 73), said product gripper means removing the products from the storage means (55) and introducing said products to the movable suction webs.

8. The system of claim 7, wherein said movable suction webs comprise endless web belts (64), a plurality of endless web belts being provided, and respectively associated with respective products;

a common control rail (84) being provided, and a plurality of pressure rollers (81), all located on said control rails, the pressure rollers being engageable with a run of the endless web belts for tensioning the web belts.

9. The system of claim 8, wherein said endless suction web belt (64) carrying the severed address fields, forming labels, apply said address field to the products as the products are being moved towards the endless web belts;

and wherein the pressure roller (81) for one product applying tension to the respective endless web belts is positioned to form a counter holding roller for an adjacent product (59) passing between the counter holding roller and the endless web belt associated with the adjacent product.

10. The system of claim 9, wherein the products are folded products;

the product gripper means (72, 73) move said products vertically downwardly; and a stop rail (97, 98) is provided, the products being moved by the grippers towards the stop rail (97, 98) for aligning the products after release of the product gripper means (72, 73) from the products on said rails.

11. The system of claim 10, wherein said rails (97, 99) are vertically movable; and operating means (99, 100) moving said rails, said rails being vertically movable between a stop position for said products (59) and a delivery position (104).

12. The system of claim 5, further including vacuum means (60, 61) pneumatically coupled to said movable suction webs, and formed with grooves or channels (62);

and openings (65) in the bottom of the grooves or channels communicating with said pneumatic suction means.

13. The system of claim 2, further including support disks (11), each carrying a plurality of address carrier rollers (31) located circumferentially on said support disks;

said support disks being rotatably positioned for placement of a selected roller (31) in a selected addressing position under control of said control means (103);

and wherein the address carrier rollers (31) have circumferentially positive stop means (15, 16, 19) for arresting the roll in a predetermined angular position.

14. The system of claim 13, wherein said circumferentially located positive stop means comprises a groove (16) formed in a predetermined circumferential position of the address roller;

a leaf spring (15) engageable in said groove;

and electromagnetic means (19) controllable under control of said control means (103) withdrawing said leaf spring (15) from the groove to permit rotation of the address roller (31) while, when said leaf spring (15) engages in said groove (16), the circumferential or angular position of said address roller is fixed; and a drive motor (21) coupled to the address roller for rotating the address roller and winding-up a strip of address carrier (6) or permitting pay-out of a strip of address carrier after release of the leaf spring (15) from the groove.

15. The system of claim 2, further including address carrier transfer means (FIGS. 8, 9, 13) for transferring the address carrier to said product, said address carrier transfer means including a piston element (39) and address carrier gripper means on said piston element for gripping an end of the address carrier strip (6);

a transport means (43) for carrying said address carrier strip along a plurality of said product:

and a transport gripper (42) on said transport means receiving the address strip from the address carrier gripper means.

16. The system of claim 2, further including of plurality of drive means and drive belts (64; 43);

a common drive element (FIGS. 15, 20: 91) for said drive means and drive belt;

and coupling elements (86, 87, 85, 88, 89) providing drive power for said common drive element (91) to said drive means and drive belt.

17. The system of claim 1, wherein the control means comprises a control computer including a memory.

* * * * *